United States Patent [19]

Roosen et al.

[11] 4,269,923

[45] May 26, 1981

[54] PHOTOGRAPHIC IMAGING PROCESS AND MATERIALS SUITABLE THEREFOR

[75] Inventors: Raymond A. Roosen, 's-Gravenwezel; Robert J. Pollet, Vremde; Antoon L. Vandenberghe, Hove, all of Belgium

[73] Assignee: AGFA-GEVAERT N.V., Mortsel, Belgium

[21] Appl. No.: 114,296

[22] Filed: Jan. 22, 1980

[51] Int. Cl.[3] ..... G03C 7/24

[52] U.S. Cl. ..... 430/140; 430/364; 430/379; 430/505; 430/565; 430/596; 430/934; 430/955

[58] Field of Search ..... 430/140, 364, 379, 505, 430/565, 596, 934, 955

[56] References Cited

U.S. PATENT DOCUMENTS

| | | | |
|---|---|---|---|
| 3,705,799 | 12/1972 | Bello et al. | 430/140 |
| 3,705,801 | 12/1972 | Holtz | 430/140 |
| 3,715,208 | 2/1973 | Lestina et al. | 430/140 |
| 3,869,287 | 4/1975 | Sakai et al. | 430/140 |
| 4,075,021 | 2/1978 | Kikuchi et al. | 430/566 |
| 4,216,284 | 8/1980 | Sakai et al. | 430/140 |

FOREIGN PATENT DOCUMENTS 2651941 5/1978 Fed. Rep. of Germany .

OTHER PUBLICATIONS

Research Disclosure, No. 11,449, Oct., 1973.

*Primary Examiner*—J. Travis Brown
*Attorney, Agent, or Firm*—A. W. Breiner

[57] ABSTRACT

Novel photographic imaging process and materials suitable therefor are provided, which can find their application in multi-color motion picture and simultaneous sound recording, in direct-positive image formation, in image-intensification processes, etc. A photographic silver image is formed in at least one hydrophilic colloid layer of a light-sensitive photographic material incorporating silver halide, by means of exposure and alkaline development steps, followed by bleaching of quantities of silver which are present in areas of said layer extraneous to those where imaging silver is required. A non-diffusible silver bleach inhibitor is initially present in said layer or is released therein during processing of the material but before the bleaching step to prevent bleaching of the required imaging silver in said layer in the bleaching step and the prevention of the bleaching of the silver by the bleach inhibitor in the areas extraneous to those where imaging silver is required is counteracted by the presence in the corresponding areas of such layer of a bleach accelerator which is caused to diffuse into such areas from an adjacent hydrophilic colloid layer during the development processing of the material.

19 Claims, 5 Drawing Figures

PHOTOGRAPHIC IMAGING PROCESS AND MATERIALS SUITABLE THEREFOR

Figures 1, 2:
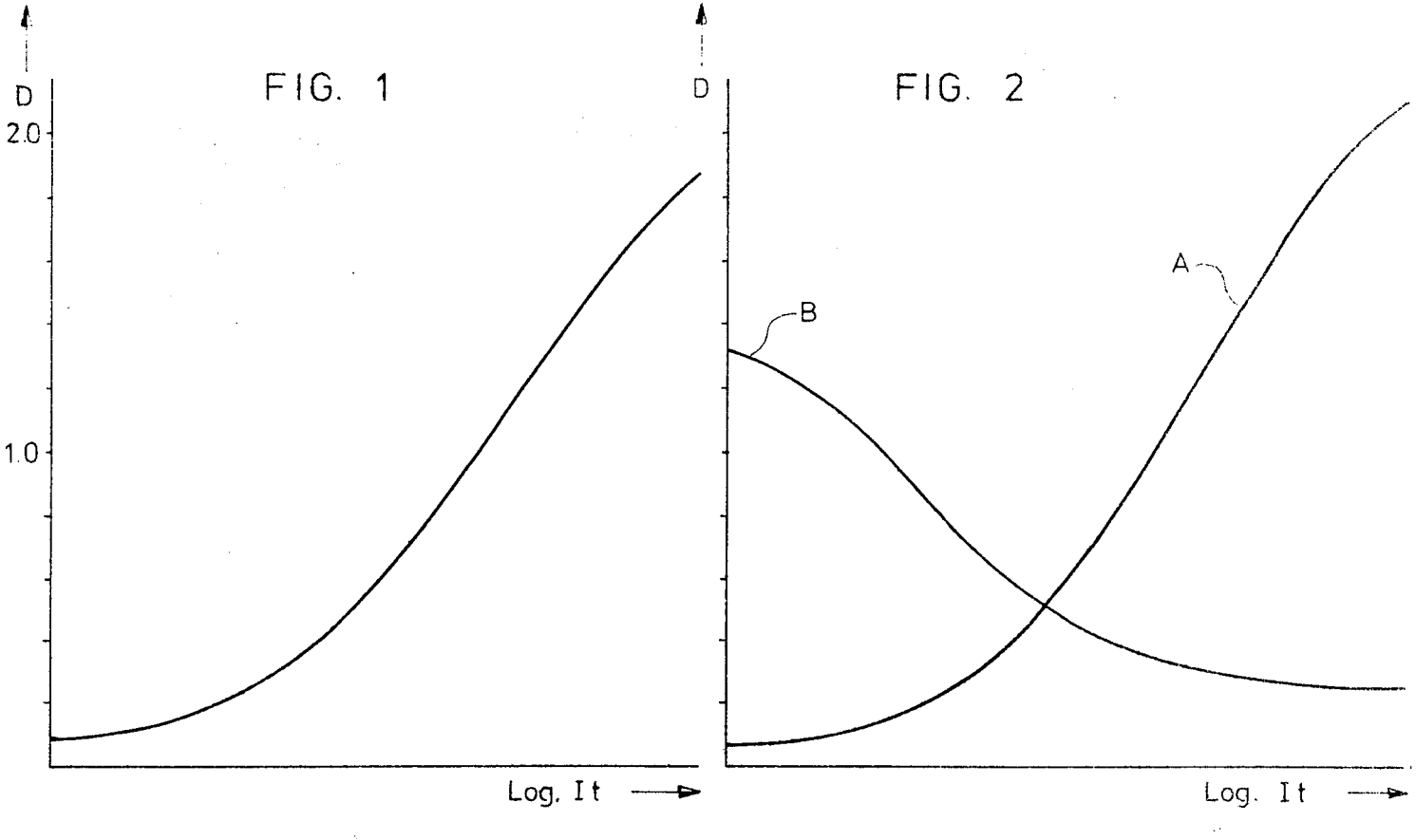

The present invention relates to an imaging process based on the controlled bleaching of silver containing layers and more particularly to photographic imaging processes and materials suitable therefor.

In the published German Patent Application DE-OS No. 2,651,920 a process is described according to which a silver image developed in a silver halide emulsion layer controls the bleaching of an underlying dyed layer e.g. a colloidal silver containing layer. In that process the areas of the dyed layer underlying the non-image areas of the developed silver halide emulsion layer are bleached before the image areas of the emulsion layer are bleached throughout the entire thickness of the emulsion layer. In the result, unbleached dye remains only in those areas of the dyed layer, which underlie the silver-containing image areas of the emulsion layer and such unbleached dye amplifies the silver image formed in the emulsion layer.

In another published German Patent Application DE-OS No. 2,651,941, a process is described according to which a silver image is formed by exposure and development of an emulsion layer overlying a dyed layer e.g. a colloidal silver containing layer. The material is treated with a compound providing sulphide ions e.g. thiourea whereupon the silver image areas as well as the areas of the dyed layer corresponding with the image areas of the emulsion layer are bleached, leaving a direct positive image of the original in the dyed layer. By treatment with the sulphide ions providing compound, sulphide ions penetrate through the undeveloped silver halide areas of the emulsion layer to make the corresponding areas of the colloidal silver containing layer unbleachable whereas they cannot penetrate through the developed silver image areas of the emulsion layer thus leaving the corresponding areas of the colloidal silver containing layer bleachable.

Another form of controlled bleaching, more particularly bleaching of a silver image in one layer with retention of a silver image in another layer is known in the production of colour motion picture films having silver sound tracks.

A currently used method of retaining metallic silver in the sound track area is to print the picture and sound track images in the photographic silver halide element and develop the latent image to metallic silver. In print films the residual silver halide is removed by fixing the entire film. In reversal films only the sound track area is fixed followed by color reversal development. At this point, both types of film have a sound track of metallic silver free from residual silver halide. The metallic silver is then converted to a fixable silver salt by bleaching both the sound track and picture areas. In the sound track area, the silver salt is reconverted to metallic silver by applying a viscous, highly active developer by means of a striping device. Subsequently, the silver salt in the picture area is removed by fixing.

In order to use a striping device the film must be taken out of the processing solutions. The conditions under which this striping process is performed are critical. If the striping wheel picks up an insufficient amount of processing composition, too little will be applied to the film and an inferior sound track can result. If the striping wheel picks up too much processing solution, the bead applied to the film will be too wide and can cover part of the picture area.

Controlled bleaching of the silver in the picture area without bleaching of the silver image in the soundtrack area can be achieved without separate treatment of the sound track area by means of bleach inhibiting compounds as described e.g. in U.S. Pat. Nos. 3,705,799, 3,705,801 and 3,715,208.

In the photographic elements of U.S. Pat. No. 3,705,799 an auxiliary layer is provided which is coated outermost from the support and over the picture recording layers. This auxiliary layer is of such photographic speed or spectral sensitivity or both that no latent image forms in the layer during picture image-forming exposure of the underlying picture recording layers. The sound record production involves exposure of the element to radiation of the appropriate wavelength of radiation and of sufficient intensity to form a latent sound record image in at least the auxiliary layer. The so exposed element is then subjected to processing comprising initial development of the latent image (either to a silver image in reversal print films or a silver and dye image in negative-positive print films), contacting the surface of the entire film with a bleach inhibitor composition, reversal development if necessary and bleach-fixing or bleaching and fixing. The processed element comprises a picture record which includes dye and a sound record which includes silver. The fact that at no point in the processing of the element do the sound record or picture record areas of the element need to be given individual treatment, is due to the presence of the auxiliary layer of the element. In the picture record area of the element, no image is formed in the auxiliary layer during exposure. During initial development the silver halide in this area of this layer does not develop to metallic silver. However, in the sound record area a latent image is formed in the auxiliary layer and is developed to metallic silver. When the element is contacted with bleach inhibitor composition the bleach inhibitor diffuses into and through the auxiliary layer in those areas where metallic silver was developed (the sound track area) much faster than in those areas where only silver halide is present (the picture area). As a result of this differential rate of diffusion of bleach inhibitor through the silver and silver halide of the auxiliary layer, only the silver of the sound record area is contacted with bleach inhibitor and is protected from the bleaching action of the bleach or bleach-fix solutions. Because the bleach inhibitor diffuses more slowly through silver halide, the picture record silver in the underlying layers is not contacted with bleach inhibitor and remains bleachable. It is, therefore, subsequently bleached and fixed out.

In order to avoid the extra treatment with bleach inhibitor composition it has been proposed in U.S. Pat. No. 3,705,801 to incorporate ballasted bleach inhibitors as substituents into the reactive sites of compounds capable of reacting with oxidized aromatic primary amine colour developing agents and to incorporate these bleach inhibitor substituted compounds into the auxiliary silver halide emulsion layer of a photographic element similar to that described in U.S. Pat. No. 3,705,799. This photographic element is then exposed to a picture record and a sound track or auxiliary record and processed for the formation of the photographic images. One of the processing steps comprises development of silver halide with an aromatic primary amine color developing agent. This development of the sound track or auxiliary record in the auxiliary layer produces oxidized aromatic primary amine color developing agent which imagewise reacts with the incorporated bleach-inhibitor-substituted compound. During this reaction the bleach inhibitor moiety is split off to form a ballasted silver bleach inhibitor which becomes adsorbed to the developed silver thereby rendering it resistant to bleaching. Subsequent to this development step, the photographic element is bleached and fixed or bleach-fixed to yield a film containing a multicolor picture record and a silver auxiliary or sound record.

In order to avoid the preparation and use of Bleach-Inhibitor-Releasing-(BIR)-compounds it has been proposed to use in an auxiliary layer for formation of the silver sound track of a photographic multicolor motion picture film for reversal processing a non diffusing ballasted silver bleach inhibitor. Such a multicolor motion picture film for reversal processing comprises a transparent support having coated thereon a plurality (generally three) of picture recording photographic units, each unit comprising one or more (generally one or two) silver halide emulsion layers which comprise non-diffusing colour couplers and are so disposed and sensitized that each photographic unit is essentially sensitive to a different primary colour region of the visible spectrum and an auxiliary silver image or silver sound recording photographic silver halide emulsion layer which does not form an image upon image forming exposure of the picture recording layers, and which contains at least one nondiffusing ballasted silver bleach inhibitor.

The auxiliary layer is of such photographic speed or spectral sensitivity or both that an image is not formed in the auxiliary layer upon image-forming exposure of the picture recording units. However, exposure to a sound track image results in the formation of a latent sound image in at least the auxiliary layer. After the black-and-white initial development step the element is fogged to render only the silver halide remaining in the picture recording units developable e.g. by means of selected aminoboranes or by flash-light affecting only such picture recording units. In the following colour development no silver image is formed in the picture recording area of the auxiliary layer. All silver except for that made unbleachable in the sound track area of the auxiliary layer by the non-diffusing bleach inhibitor is then removed by bleaching.

The use in a multilayer motion picture colour film for sound track recording, of a non-diffusing bleach inhibitor or bleach inhibitor releasing compound in an auxiliary layer, whose speed or spectral sensitivity or both is selected so that no latent image is formed therein during image-wise exposure of the picture recording area has the disadvantage that as the sound track image is recorded in this auxiliary layer it must satisfy various special conditions for making high quality sound recording possible.

It is an object of the present invention to provide novel imaging processes and materials suitable therefor, based on the controlled oxidative bleaching of silver containing layers.

It has been found that by diffusion of a bleach accelerating compound from areas of a hydrophilic colloid layer of a photographic material to corresponding areas of a hydrophilic colloid layer in water-permeable relationship therewith it is possible to suppress in such areas of the latter layer the bleach inhibiting effect of a bleach inhibiting compound on silver that is provided or formed in the latter layer.

The present invention provides a process wherein a photographic silver image is formed in at least one hydrophilic colloid layer of a light-sensitive photographic material incorporating silver halide, by means of exposure and alkaline development steps, followed by bleaching of quantities of silver which are present in areas of said layer extraneous to those where imaging silver is required, characterized in that a non-diffusible silver bleach inhibitor is initially present in said layer or is released therein during the processing of the material before the bleaching step e.g. during alkaline development, to prevent bleaching of the required imaging silver in said layer in the bleaching step and in that the prevention of the bleaching of the silver by the bleach inhibitor in the areas extraneous to those where imaging silver is required is counteracted by the presence in the corresponding areas of such layer of a bleach accelerator which is caused to diffuse into such areas from an adjacent hydrophilic colloid layer during the development processing of the material.

In order to simplify the following further description the hydrophilic colloid layer(s) in which the required silver image is to be formed will alternatively be called "the silver-imaging layer". It should be borne in mind that such layer can in fact be a plural layer coating.

The process of the present invention can be carried out using a photographic material in which the silver-imaging layer(s) initially contain(s) in overall distribution therein either colloidal silver or silver halide which has been rendered developable by preliminary overall exposure or chemical fogging in addition to a non-diffusing ballasted silver bleach inhibitor and/or a non-diffusing bleach inhibitor releasing compound (BIR-compound) capable of forming a non-diffusable silver bleach inhibitor e.g. under alkaline development conditions as referred to hereinafter. The adjacent hydrophilic colloid layer (hereafter alternatively called 'the accelerator release layer') from which the bleach accelerator diffuses is a light-sensitive silver halide emulsion layer containing a non-diffusing bleach accelerator releasing compound (BAR-compound) capable of forming a diffusible bleach accelerator upon alkaline development of a latent silver image formed in such accelerator release layer. Upon image-wise exposure of such accelerator release layer and alkaline development of the material a diffusible bleach accelerator is released in such accelerator release layer in a distribution, within the area of the material which depends on and is in accordance with the silver image developed therein and diffuses in such distribution into the silver-imaging layer containing colloidal silver or developed silver and bleach inhibitor (optionally released from the BIR-compound). In that silver imaging layer the bleach accelerator counteracts the silver bleach inhibiting effect of the bleach inhibitor in the subsequent bleaching step. The bleaching step is usually followed by a fixing step or the fixing step is combined with the bleaching step.

Alternatively, the invention can be carried out using a photographic material wherein the silver-imaging layer comprises a light-sensitive silver halide emulsion containing a said bleach inhibitor and/or BIR-compound, and the said accelerator release layer is a hydrophilic colloid layer which contains developable silver halide (the silver halide having been rendered developable e.g. by preliminary exposure) in addition to a said BAR-compound. Upon image-wise exposure of the silver-imaging layer and alkaline development of the photographic material, a diffusible bleach accelerator is released in the accelerator release layer in a distribution within the area of the material, which depends on the development of silver in that layer and diffuses in corresponding distribution into the silver-imaging layer in which silver image is formed by the alkaline development. In that silver-imaging layer the bleach accelerator counteracts the silver bleach inhibiting effect of the bleach inhibitor in the subsequent bleaching step.

The present invention includes a photographic material suitable for use in the foregoing process and comprising a support carrying:

(1) a hydrophilic colloid silver halide emulsion layer (hereinafter again alternatively called "accelerator release layer") containing a non-diffusing bleach accelerator releasing compound (BAR-compound) capable of forming a diffusible bleach accelerator upon alkaline development of a latent silver image which is present or can be formed in the said silver halide emulsion layer, and (2) at least one hydrophilic colloid layer such layer hereinafter again being called silver-imaging layer which is in water-permeable relationship with the said accelerator-release layer and which contains either a light-sensitive silver halide emulsion or in overall distribution colloidal silver or silver halide which has been rendered overall developable by overall exposure or chemical fogging and which silver-imaging layer contains a non-diffusing ballasted silver bleach inhibitor and/or a non-diffusing bleach inhibitor releasing compound (BIR-compound) capable of forming a non-diffusible silver bleach inhibitor at least in the areas where the colloidal silver is present or developed silver is formed.

In the above accelerator-release layer the BAR-compound can be:

(a) a substantially colourless BAR-compound capable of reacting with oxidized developing agent and capable of releasing in alkaline medium by said reaction a substantially colourless diffusible accelerator of bleaching, or (b) a substantially colourless BAR-compound capable of releasing a diffusible substantially colourless bleach accelerator under alkaline conditions and capable of being reduced by non-oxidized developing agent to form by said reduction a reaction product having a substantially lower rate of release of the bleach accelerator under alkaline conditions, or (c) a substantially colourless BAR-compound capable of releasing under alkaline conditions a substantially colourless diffusible accelerator of bleaching and capable of reacting with oxidized developing agent to form a reaction product having a substantially lower rate of release of the bleach accelerator under alkaline conditions, or (d) a substantially colourless BAR-compound capable of being reduced by non-oxidized developing agent to form by said reduction a reaction product having a substantially higher rate of release of a diffusible substantially colourless bleach accelerator under alkaline conditions.

In the above silver-imaging layer(s) the BIR-compound can be:

(a) a compound capable of releasing a non-diffusible bleach inhibitor under alkaline conditions, or (b) a compound capable of releasing non-diffusible bleach inhibitor by reaction with oxidized silver halide developing agent (formed by the development of developable silver halide in said layer) and alkali; or (c) a compound capable of releasing non-diffusible bleach inhibitor under alkaline conditions and capable of being reduced by non-oxidized developing agent to form by said reduction a reaction product having a substantially lower rate of release of the bleach inhibitor under alkaline conditions.

The accelerator-release layer of the materials according to the invention can be a silver halide emulsion layer forming upon image-wise exposure and silver halide development a negative image or it can be a silver halide emulsion layer forming upon image-wise exposure and silver halide development a direct-positive image.

The above processes and materials are useful for a variety of applications and in particular for direct-positive image formation through the intermediary of a negative silver halide emulsion and for simultaneous (multi)colour motion picture and sound recording as is illustrated hereinafter with reference to FIGS. 3, 4, and 5 of the accompanying drawings.

A direct-positive image can be formed in a photographic material according to the invention comprising a support carrying a hydrophilic colloid (silver-imaging) layer containing a non-diffusible bleach inhibitor and colloidal silver, and in water-permeable relationship with said hydrophilic colloid layer a light-sensitive silver halide emulsion (accelerator release) layer of negative type containing a BAR-compound capable of reacting with an oxidized developing agent and releasing in alkaline medium by said reaction a substantially colourless diffusible bleach accelerator, by the steps of (1) image-wise exposure of the said accelerator release layer, (2) developing in alkaline medium the exposed silver halide of such accelerator release layer by means of a developing agent whereby a diffusible bleach accelerator is released in the exposed areas and diffuses into the hydrophilic colloid layer containing the bleach inhibitor, and (3) treating the material with a silver bleach solution and a fixing solution or with bleach-fixing solution.

Figure 3:
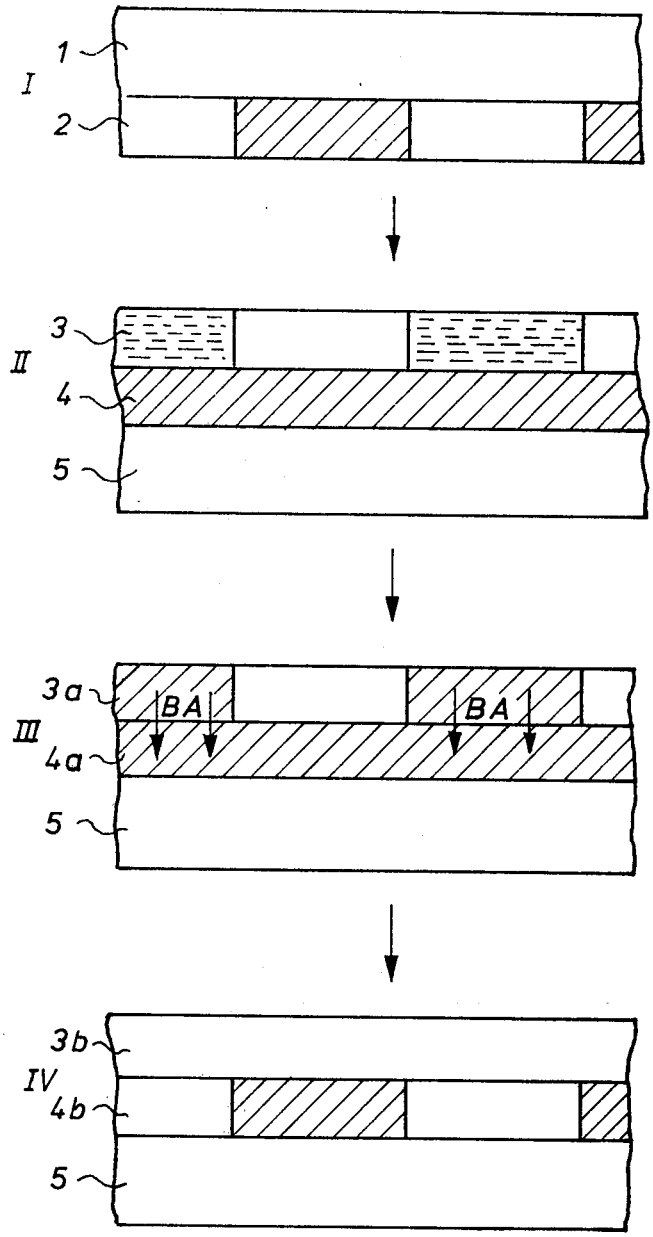

For a better understanding of this direct-positive image formation there is referred to FIG. 3 of the accompanying drawings. FIG. 3 shows diagrammatically and sequentially the formation of a direct-positive image according to the process of the present invention. FIG. 3 comprises four views I to IV. View I represents the original of which (1) is the support and (2) is an image-bearing layer. Views II to IV represent a material according to the present invention at different stage in its use. View II shows the material after exposure through the original. In this view, (3) is the exposed negative emulsion (accelerator release) layer containing the BAR-compound, (4) is the hydrophilic colloid (silver-imaging) layer containing colloidal silver and non-diffusible bleach inhibitor and (5) is the support of this material. View III represents the material after alkaline development, wherein (3*a*) is the accelerator release layer showing a negative image of the original and BA represents diffusion of bleach accelerator from the silver image areas of layer (3*a*) into silver-imaging layer (4*a*) containing colloidal silver. View IV represents the material after treatment with the bleach and fixing solution. In layer (3*b*) all unexposed silver halide and all silver formed in the exposed areas are removed. In the areas of the silver-imaging layer (4*b*) underlying the exposed areas of layer (3*b*) all colloidal silver is removed because in these areas the bleach inhibiting effect of the bleach inhibitor is counteracted by the diffused bleach accelerator. In the areas of the silver-imaging layer corresponding to the non-exposed areas of the accelerator release layer the bleach inhibitor (preferably ballasted) remains effective so that no silver is bleached and a direct-positive silver image of the original is formed.

The photographic material for the above direct-positive image formation can alternatively contain as BAR-compound a compound which releases a diffusible substantially colourless bleach accelerator under alkaline conditions but is capable of being reduced by non-oxidized developing agent to form by said reduction a reaction product having a substantially lower rate of release of the bleach accelerator under alkaline conditions.

Instead of the non-diffusible bleach inhibitor the above photographic material can comprise a bleach inhibitor releasing compound capable of releasing a non-diffusible substantially colourless bleach inhibitor under alkaline conditions so that the bleach inhibitor is released during alkaline development.

If in the above process the material comprises a BAR-compound which releases the bleach accelerator in the non-exposed areas of the negative emulsion layer not a direct-positive image is formed but an intensified negative image.

The colloidal silver used in the above material can be formed in known ways e.g. by chemical reduction of a silver salt such as silver nitrate. The colloidal silver is then admixed with an aqueous hydrophilic colloid e.g. aqueous gelatin to form a hydrophilic colloid coating composition.

The hydrophilic colloid silver-imaging layer can contain in overall distribution instead of colloidal silver, developable silver halide i.e. silver halide that has been made developable by overall chemical fogging or overall exposure or it can contain simply light-sensitive silver halide. In the latter case the silver-imaging layer is rendered developable by overall exposure e.g. through the support before image-wise exposing of the light-sensitive accelerator release layer containing the BAR-compound. Instead of a bleach inhibitor, one of the above types of bleach inhibitor releasing compounds can be used in the imaging layer.

Processes and materials according to the present invention can also be used for forming separate silver and dye image records more particularly a silver sound record and a colour picture record in different areas of a photographic material.

For this purpose the photographic material comprises one or more colour picture recording units each unit being composed of one or more silver halide emulsion layers (generally one or two) and an auxiliary silver halide emulsion layer which is capable of being exposed without image-forming exposure of the picture recording unit(s) characterised in that (1) the auxiliary silver halide emulsion layer(s) is an accelerator-release layer comprising a BAR-compound capable of releasing a diffusible silver bleach accelerator in alkaline medium as referred to hereinbefore, and (2) at least one of the emulsion layers of the colour picture recording unit is a silver-imaging layer being in water-permeable relationship with the said auxiliary silver halide emulsion layer and containing a non-diffusing silver bleach inhibitor or a non-diffusing BIR-compound capable of releasing a non-diffusible ballasted bleach inhibitor as referred to hereinbefore.

Materials for motion picture plus sound recording according to the invention can be used either in the negative-positive system of photography or in the reversal system of photography.

The process for the formation of motion picture films with silver sound track according to the negative-positive system of photography using a photographic material as above specified and wherein the BAR-compound is a compound which is capable of releasing the bleach accelerator upon reaction with oxidized developing agent in alkaline medium or is a compound which is capable of losing its capability of releasing in alkaline medium a bleach accelerator upon reduction by non-oxidized developing agent comprises the steps of: (1) overall exposing the accelerator-release layer in the picture recording area of the film only if the said accelerator-release layer comprises a negative type silver halide emulsion or in the sound-track recording area only if such accelerator-release layer comprises a direct-positive type silver halide emulsion e.g. comprises fogged silver halide grains, such overall exposure being effected without exposing the picture recording units, (2) image-wise exposing the picture area and sound track area of the picture recording units (without image-forming exposure of the accelerator-release layer or at least that area thereof which has not been overall exposed), (3) colour developing the material with an aromatic primary amino developing agent to form a picture record comprising silver and dye in the picture recording layers and silver in the picture record area of the accelerator release layer, thereby releasing in the picture record area of the accelerator release layer diffusible bleach accelerator, this bleach accelerator diffusing into the picture record area of the picture recording units thus neutralizing the bleach inhibiting effect of the bleach inhibitor which was initially present in the silver-imaging layer(s) of said units or was formed therein by the alkaline development or formed therein together with the silver image from a bleach-inhibitor releasing compound, (4) removing the residual silver halide and bleachable silver remaining after step (3) by bleaching and fixing, while retaining in the sound-track area of the silver-imaging layer(s) of the picture recording units, silver whose bleaching is inhibited by the bleach inhibitor or released bleach inhibitor not neutralized in this area.

Figure 4:
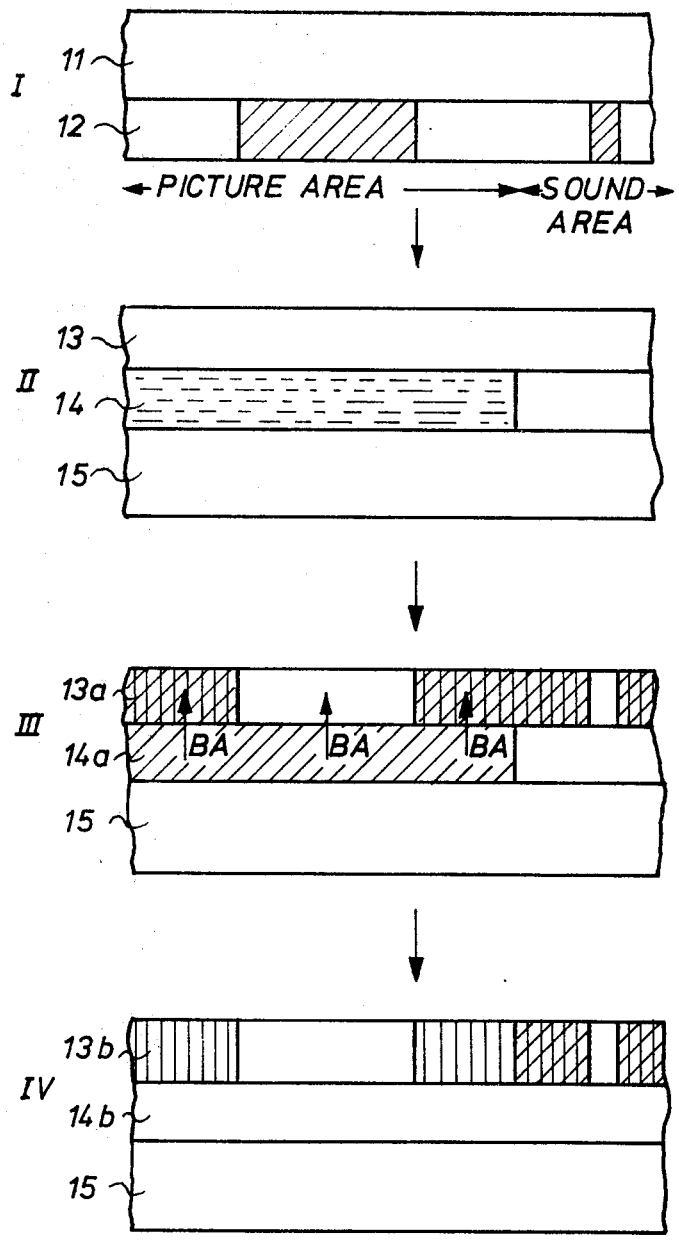

For a better understanding of the above motion picture and sound recording process of the present invention according to the negative-positive system of photography there is referred to FIG. 4 of the accompanying drawings. FIG. 4 shows diagrammatically and sequentially the simultaneous dye image formation and silver sound track formation. In FIG. 4 view I represents the original, depicted for simplification of the figure as a single layer 12 coated on a transparent support 11. In practice this original can be a multilayer, multicolor element or a scene as viewed through a camera lens. Also, in practice the picture record and sound track record would generally be on separate originals and separate exposures made from each of these originals a short interval of time apart. View II represents a material according to the present invention wherein transparent film support 15 has coated thereon first an auxiliary negative silver halide emulsion layer 14 (accelerator-release layer) which contains a BAR-compound capable of releasing bleach accelerator upon reaction with oxidized aromatic primary amino developing agent in alkaline medium and which has been overall exposed in the picture record area of the material only, and secondly a colour picture recording negative emulsion (silver-imaging) layer 13 comprising a non-diffusible bleach inhibitor and a colour coupler capable of forming a dye with oxidized developing agent. For simplification only one dye image providing emulsion layer is represented in the figure and conventional subbing layers, interlayers and the overcoat have been omitted from the drawing.

In carrying out the above process of the present invention the colour picture recording emulsion layer (silver-imaging layer) is exposed to the picture record and sound record and the material is developed in a colour developer. The material then appears as shown in view III of FIG. 4. Layer 13*a* contains both in the picture record area and sound record area a silver and dye image. All over the picture record area of layer 14*a* silver is formed and by reaction in this area of the BAR-compound, bleach accelerator (BA) is released which can diffuse into layer 13*a* to counteract the bleach inhibiting effect in that layer of the bleach inhibitor. Subsequent to the development the material is bleached and fixed or bleach-fixed. View IV of FIG. 4 represents the material after bleaching and fixing. Layer 14*b* is clear, all silver having been removed by bleaching and fixing. In layer 13*b* silver has been removed in the picture record area only since in that area the bleach accelerator counteracted the bleach inhibiting effect of the bleach inhibitor. In the sound track area on the contrary there remains a silver and dye image.

If contrary to the foregoing example the auxiliary (accelerator-release) layer of the photographic material contains a BAR-compound which loses its bleach accelerator release capability in alkaline medium upon reaction with oxidized developing agent or a BAR-compound which is capable of releasing the bleach accelerator upon reaction with non-oxidized developing agent in alkaline medium, the initial exposure of the accelerator-release layer should be an overall exposure of the sound-track area only in the case that the accelerator-release layer comprises a negative type emulsion, and of the picture recording area only in the case that the accelerator-release layer comprises a direct-positive type emulsion. In the image-wise exposure step of the process the accelerator release layer is in these circumstances not exposed or at least not the area thereof that has not been overall exposed. Consequently, in the development step silver is formed in the sound-track recording area of the auxiliary layer.

Motion picture films with silver sound track can be produced according to the reversal system of photography by using a photographic material according to the present invention wherein the auxiliary (accelerator release) layer comprises a negative type silver halide emulsion containing a bleach-accelerator releasing compound capable of reacting with an oxidized aromatic primary amino colour developing agent and releasing thereby a bleach accelerator and wherein the silver-imaging layer or layers of the picture recording unit(s) does not contain a bleach inhibitor compound but rather a bleach inhibitor releasing compound capable of reacting with an oxidized aromatic primary amino colour developing agent and releasing thereby a bleach inhibitor. The process comprises the steps of:

(1) Overall exposing the auxiliary (accelerator-release) silver halide emulsion layer only in the sound-track recording area of the film without exposure of the picture recording area,
(2) image-wise exposing the picture recording units in the picture area and sound track area,
(3) black-and-white development to form a negative silver image in the picture recording units and silver in the sound track area of the auxiliary (accelerator-release) layer,
(4) overall fogging and colour developing with an aromatic primary amino compound the remaining silver halide in the material to form in the picture recording layers a picture and sound record comprising silver and dye and in the auxiliary layer silver in the picture record area thereof, oxidized aromatic primary amino developing agent reacting in the picture record area of the auxiliary (accelerator-release) layer with the bleach accelerator releasing compound to release diffusible bleach accelerator and in the silver-imaging layer(s) of the picture record units with the bleach inhibitor releasing compound to release bleach inhibitor, the said released bleach inhibitor being neutralized in its inhibiting effect by the diffusing bleach accelerator in the picture record area of the silver-imaging layer(s) of the picture record units,
(5) removing any residual silver halide and bleachable silver remaining after such colour development by bleaching and fixing, while leaving in the sound track area of silver-imaging layer(s) of the picture recording units, the silver which was formed during colour development and was made unbleachable by released bleach inhibitor not neutralized in that area.

Figure 5:
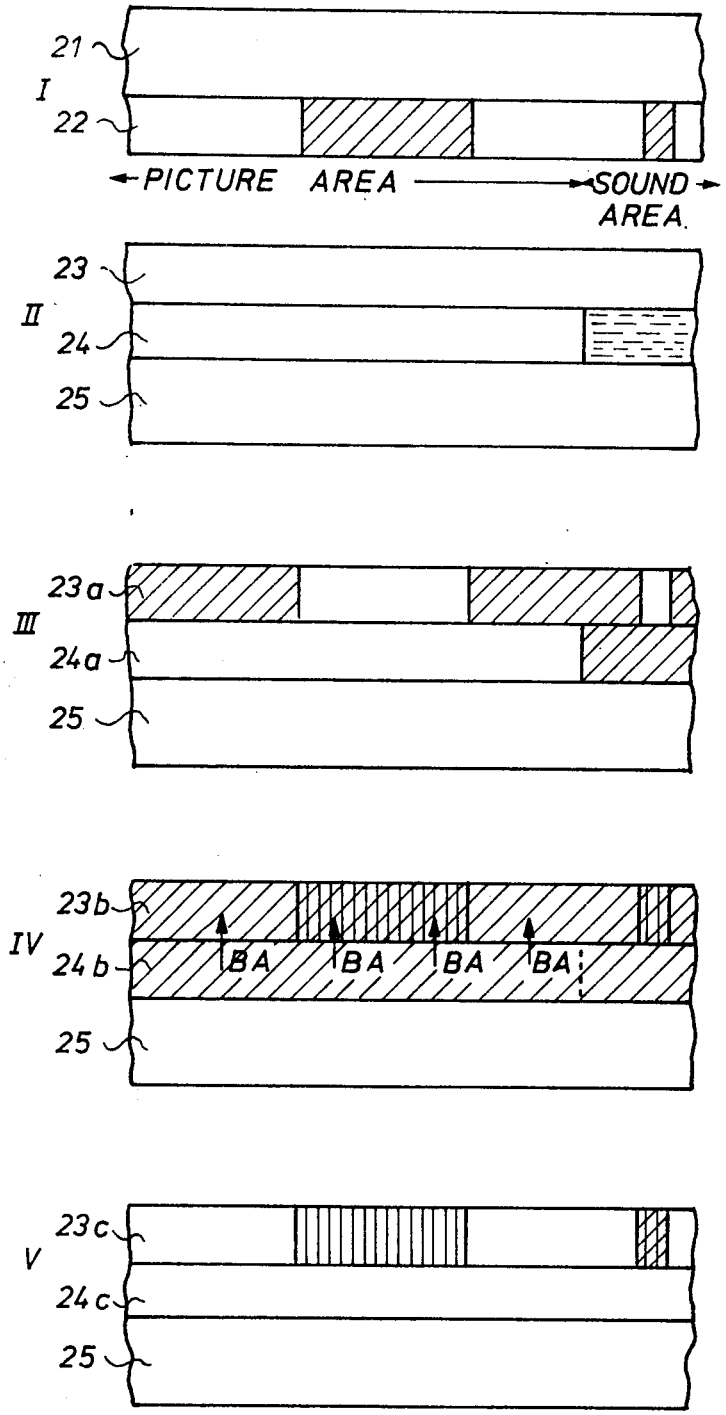

For a better understanding of the above motion picture and sound recording process of the present invention according to the reversal system of photography there is referred to FIG. 5 of the accompanying drawings. In this FIG. 5 the same simplification measures have been taken as described for FIG. 4. In FIG. 5 view I represents an original depicted for simplification as a single layer 22 on a transparent support 21. View II represents the material according to the invention wherein transparent film support 25 has coated thereon first an auxiliary (accelerator-release) negative silver halide emulsion layer 24 which contains a BAR-compound capable of releasing a bleach accelerator by reaction with oxidized aromatic primary amino colour developing agent, and which has been overall exposed in the sound track area of the material only, and secondly a colour picture recording negative emulsion layer (silver-imaging layer) 23 comprising a BIR-compound capable of releasing bleach inhibitor by reaction with oxidized aromatic primary amino colour developing agent.

In carrying out the above process the colour picture recording emulsion layer is exposed to the picture record and sound record and the material is then first developed in a black-and-white developer. The material then appears as in view III of FIG. 5. Layer 24*a* shows silver all over the sound track area and layer 23*a* has a silver image both in the sound track area and picture record area. By the subsequent overall fogging and colour development the remaining silver halide in layers 23*a* and 24*a* is developed to silver and the material appears as in view IV of FIG. 5. In the areas of layer 23*b* where such silver halide was fogged and colour developed dye is formed in addition to silver and a non-diffusible bleach inhibitor is released in these areas. In the picture record area of layer 24*b* where colour development occurred, a diffusible bleach accelerator is released and diffuses into the corresponding area of layer 23*b*. View V of FIG. 5 represents the material after bleaching and fixing. Layer 24c is clear, all silver having been removed by bleaching and fixing. In the areas of layer 23b where dye and silver were formed, the silver has been removed from the picture record area only and not from the sound track area since it was only into the first area that bleach accelerator diffused to counteract the bleach inhibiting effect of the released bleach inhibitor.

The image-wise exposure of the sound track area in the latter process, occurs by means of a positive sound recording film as commonly used for silver sulphide sound track formation.

The photographic materials of the invention for preparing multicolour motion picture films having a silver sound track comprise generally a transparent support having coated thereon a plurality (generally three) of picture recording photographic units, each unit comprising one or more (generally one or two) silver halide emulsion layers which are so disposed and sensitized that each photographic unit is essentially sensitive to a different primary colour region of the visible spectrum, and an auxiliary (accelerator-release) silver halide emulsion layer which can be image-wise exposed without image-forming exposure of the picture recording layers. The accelerator-release layer preferably contains at least one BAR-compound which forms a silver bleach accelerator upon reaction with oxidized aromatic primary amine colour developing agent in alkaline medium; however it may also comprise other types of BAR-compounds as referred to hereinbefore. At least one emulsion layer of at least one of the picture recording units comprises at least one non-diffusible bleach inhibitor or bleach inhibitor releasing compound as referred to above. Normally, each picture recording layer contains a non-diffusing photographic colour coupler which reacts with oxidized aromatic primary amino colour developing agent to form a dye. The dye that is formed in each layer is complementary in colour to the sensitivity of the emulsion in which it is incorporated. However, the photographic material can have layers which do not contain incorporated couplers. In this case, the exposed material can be processed in the presence of a coupler developing composition. This coupler-developer composition contains both diffusible photographic developing agents such as the aromatic primary amines and diffusible photographic colour couplers. The oxidized photographic developing agent couples with the diffusible colour coupler to form a non-diffusible dye at the site of photographic silver halide development.

The bleach inhibitor releasing compounds normally do not form coloured reaction products upon reaction with oxidized aromatic primary amino compounds but they may form dyes complementary in colour to the sensitivity of the emulsion in which they are incorporated. The bleach accelerator releasing compounds normally form colourless reaction products as they do not take part in forming the dyestuff image.

Particularly useful photographic materials for multicolour motion picture plus sound recording comprise a support having coated thereon:

(1) a picture recording colour-forming unit comprising at least one photographic silver halide emulsion layer primary sensitive to the blue region of the visible spectrum and containing a non-diffusing photographic coupler which reacts with oxidized aromatic primary amine colour developing agent to form a non-diffusing yellow dye; (2) a picture recording photographic colour-forming unit comprising at least one silver halide emulsion layer primarily sensitive to the red region of the visible spectrum and containing a non-diffusing photographic coupler which reacts with oxidized aromatic primary amine colour developing agent to form a non-diffusing cyan dye; (3) a picture recording photographic colour-forming unit comprising at least one silver halide emulsion layer primarily sensitive to the green region of the visible spectrum and containing a non-diffusing photographic coupler which reacts with oxidized aromatic primary amine colour developing agent to form a non-diffusing magenta dye; and (4) an auxiliary photographic silver halide emulsion layer which can be image-wise exposed without image-forming exposure of the picture recording units.

The auxiliary layer (4) should not impair the quality of the images formed in the picture recording units and therefore if the motion picture film contains the above silver halide emulsion layers in the order given, the auxiliary layer should be a coarse-grained emulsion layer in order to reduce light-scattering during exposure or otherwise the auxiliary layer should be situated at leaste underneath picture-recording unit (3).

A film material comprising the picture recording units in the above order of sequence given is one generally used for positive print material.

A reversal print material comprises generally the following picture recording layers in the order of sequence given from the support: an above picture recording unit (2), an above picture recording unit (3), a yellow filter layer and an above picture recording unit (1).

At least one of the silver halide emulsion layers of the red- and green-sensitized picture recording units comprise a non-diffusible bleach inhibitor or bleach inhibitor releasing compound as referred to hereinbefore and the said auxiliary silver halide emulsion layer comprises a bleach accelerator releasing compound as referred hereinbefore.

In the process for simultaneous motion picture and sound recording the auxiliary silver halide emulsion layer referred to hereinbefore is exposed in the sound track area or picture recording area only. This exposure is normally effected prior to image-wise exposure of the picture recording units, during manufacture of the motion picture film e.g. during recording of edge mark information as currently practised for such materials.

The present invention thus also provides materials for motion picture and sound recording as referred to above wherein the auxiliary silver halide emulsion layer has been overall exposed to actinic radiation (or chemically fogged) in the picture recording area thereof only or in the sound track recording area thereof only whereas the picture recording units have not been exposed (or fogged).

The auxiliary silver halide emulsion layer of the photographic material is only used to set free in the picture record area as is apparent from the above, a diffusible bleach accelerator. This layer can be present anywhere in the material provided with the picture recording unit(s) comprising the bleach inhibitor or bleach inhibitor releasing compound. For example, it can be coated as the light-sensitive layer closest to the support or alternatively it can be coated as a light-sensitive layer outermost from the support. In addition, it can be coated between two of the picture recording units or it can be coated between a picture recording unit and a filter layer if the element contains filter layers. The overall exposure of the auxiliary layer in the sound-track area or picture recording area referred to in the above processes should not effect exposure of the picture recording units. Depending upon the arrangement of the picture recording units and auxiliary layers and filter layers, if any, various methods of exposure can be utilized to achieve exposure while at the same time not exposing the picture recording layers. For example, with the auxiliary layer as the light-sensitive layer closest to the support and with a removable, e.g. bleachable, filter layer between the auxiliary layer and the picture recording units, the picture recording layers can be exposed from the emulsion side of the support and auxiliary layer exposed through the support. Alternatively, with the auxiliary layer as the light-sensitive layer outermost from the support and with a removable filter layer between the auxiliary layer and the underlying picture recording layers, picture exposure can be through the support and auxiliary image exposure can be from the emulsion side. Generally however, it is desirable to expose all layers from the emulsion side. Selective exposure of the auxiliary and picture recording layers is attained in this case because of the photographic speed or spectral sensitivity or both of this layer. For example, the auxiliary layer can be sensitized to radiation to which the picture recording layers are at least partially insensitive such as infrared radiation and exposure is then made through the appropriate filters. Sensitization to the region of relatively equal minimum sensitivity between two of the picture recording layers is still another alternative. Examples are those regions between the blue and green sensitive layers or the green and red sensitive layers of a colour film having three colour-forming units, each primarily sensitive to a different primary region of the visible spectrum. In addition to or instead of the spectral sensitization, the auxiliary layer can be of a different photographic speed. For example, the auxiliary layer can be unsensitized but have a relative inherent sensitivity to ultraviolet and near blue radiation higher e.g. from 2 to 50 times higher than that of any of the picture recording silver halide emulsion layers so that an exposure can be chosen which has no effect on the picture recording layers.

Where in the negative positive process of photography described above, the auxiliary layer is overall exposed in the picture recording area only and not in the sound recording area the following image-wise exposure of the picture recording units in the sound recording area should not cause exposure of the auxiliary layer in this area. Various methods of exposure as described above can be used to achieve this. Since normally exposure of the sound track occurs through a yellow filter so that the silver sound track is only formed in the green and red-sensitive layers of a colour film having three colour forming units, a non-spectrally sensitized auxiliary silver halide emulsion having only ultraviolet and blue sensitivity will not be affected by such exposure through a yellow filter. Thus the above processes wherein the picture recording area of the auxiliary layer are overall exposed are preferred.

The materials and processes of the present invention for the formation of multicolour motion picture films with silver sound tracks have silver sound tracks of high quality as they are formed in the picture recording layers and not in an auxiliary layer. Since the auxiliary layer of the elements of the present invention is neither a picture forming element nor sound track forming element it should not fulfil special requirements as to quality.

The method of our invention is useful to prevent the bleaching of sound records by both bleach compositions and bleach-fix compositions. Bleach compositions contain, for example, potassium dichromate, potassium ferricyanide or potassium persulphate as the oxidizing agent. Bleach-fix compositions are those which contain an oxidizing agent such as an iron salt of EDTA and a silver halide solvent. In a bleach-fix composition, the silver is oxidized to a silver salt which is then removed from the film all in a single solution. Bleach compositions, however, only oxidize the silver to a silver salt. This silver salt and residual silver halide are subsequently removed by treatment with a separate fixing bath.

In the processes and materials described hereinbefore non-diffusing bleach inhibiting (BI) compounds or bleach inhibitor releasing (BIR) compounds are used.

Ballasted bleach inhibiting compounds suitable for use according to the present invention are known in the art and have been described e.g. in U.S. Pat. Nos. 3,705,799 and 3,705,803 and in the published German Patent Applications DE-OS Nos. 2,405,279, 2,412,078 and 2,412,610. Compounds which exhibit particular utility as ballasted bleach inhibitors are thiol- and selenol-containing compounds which are substituted with or contain a hydrophobic moiety such as a medium to long alkyl chain.

Organic compounds which exhibit particular utility as bleach inhibitors are thio- and seleno-containing compounds such as mercapto- and selenol-substituted alkanoic acids, especially 2-mercaptoalkanoic acids, thiol- and selenol-substituted aryls, such as thiophenols and thionaphthols, thiol- and selenol-substituted heterocyclic compounds containing 5 to 6 atoms in the hetero ring, said ring containing at least one nitrogen atom such as mercaptobenzoxazoles, mercaptobenzothiazoles, mercaptobenzimidazoles, mercaptothiodiazoles, mercaptotriazoles, 1-phenyl-5-mercaptotetrazoles and mercaptoquinolines, thiocarboxylic acids and esters thereof such as thiobenzoic acid and xanthates such as potassium octyl xanthate.

It is also possible to use ballasted heterocyclic N-containing compounds with a thioether moiety linked through the thioether S-atom to the heterocyclic ring as described in the above published German Patent Applications.

Other suitable bleach inhibitors are onium compounds which include ammonium, phosphonium and sulphonium compounds. Representative examples thereof are:

1. poly-1-vinyl-imidazolinium iodide,
2. N-dodecylpyridinium chloride

3. 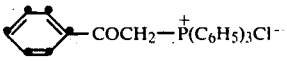

4. 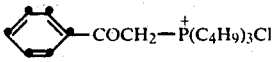

5. $(C_6H_5)_3P^+—CH=CH—P^+(C_6H_5)_32Br^-$
6. $(C_6H_5)_3P^+—C_{18}H_{37}Br^-$
7. $(C_6H_5)_3P^+—(CH_2)_2OHCl^-$
8. $(C_4H_9)_3P^+—(CH_2)_{15}CH_3Br^-$
9. $(C_6H_5)_3P^+—(CH_2)_{15}CH_3Br^-$
10. $(C_6H_5)_3P^+—C_{22}H_{45}Br^-$

11. $(C_6H_5)_3\overset{+}{P}-(CH_2CH_2O-)_3CH_2CH_2\overset{+}{P}(C_6H_5)_3$ 2 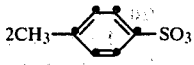

12. $(C_4H_9)_3\overset{+}{P}-(CH_2CH_2O-)_8CH_2CH_2\overset{+}{P}(C_4H_9)_3$ 2 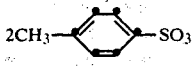

13. $(C_6H_5)_3P^+-(CH_2)_5CH_3Br^-$
14. $(C_6H_5)_3P^+-(CH_2)_9CH_3Br^-$
15. $(C_6H_5)_3P^+-(CH_2)_{17}CH_3I^-$

16. $(C_6H_5)_3\overset{+}{P}-CH_2-$ 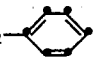 $Br^-$

17. $HO-\left[CH(CH_2{}^{+}P(C_4H_9)_3)CH_2O\right]_n-H$ $nBr^-$ n = 21.6

18. $HO-\left[CH(CH_2{}^{+}P(C_6H_5)_3)CH_2O\right]_n-H$ $nCl^-$ n = 21.6

19. $HO-\left[CH(CH_2{}^{+}S(CH_3)-(CH_2)_{11}CH_3)CH_2O\right]_n-H$ $n(CH_3SO_4^-)$ n = 21.6

20. $(H_3C)_2\overset{+}{S}(CH_2)_{11}CH_3$ $H_3C-$ 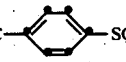 $-SO_2^-$

21. $H_{25}C_{12}\overset{+}{S}(CH_3)CH_2-$ 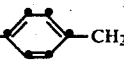 $-CH_2\overset{+}{S}(CH_3)C_{12}H_{25}$ 2 $H_3C-$ 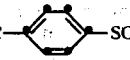 $-SO_3^-$ As bleach inhibitor releasing compounds can be used precursors which form the bleach inhibitor e.g. thiol or selenol upon hydrolysis prior to the bleaching step in the above processes. Other bleach inhibitor releasing compounds are disulphides which cleave at the sulphur atom to yield at least one thiol compound. For such bleach inhibitor releasing compounds there can likewise be referred to U.S. Pat. Nos. 3,705,799 and 3,705,803.

Other bleach inhibitor releasing compounds for use with silver halide emulsion layers are compounds releasing bleach inhibitor upon alkaline development in the areas where the silver image is formed. Compounds releasing photographically useful groups upon alkaline development are well known in the art of photographic silver halide photography.

Well known are couplers which can be any compound having an active site capable of reacting with oxidized aromatic primary amine colour developing agent and which can be substituted in this active site with a photographic useful compound and which retains its reactivity to the oxidized colour developing agent when so substituted the substituent compound being split off by the reaction. Many compounds are suitable for this purpose. Particularly suitable are photographic colour couplers such as 2-pyrazolin-5-one couplers, phenolic couplers, α-naphtholic couplers and open-chain-ketomethylene couplers such couplers reacting with oxidized aromatic primary amines to form generally magenta, cyan and yellow dyes respectively.

These couplers can be substituted, for use according to the present invention, in the coupling position with a ballasted bleach inhibitor forming moiety to form a BIR-coupler. More details about and examples of BIR-couplers can be found in U.S. Pat. No. 3,705,801.

Also useful are the non-diffusible bleach-inhibitor releasing hydroquinones including naphthoquinones. They contain a hydrophobic group linked to the aromatic nucleus through a thio or seleno group. They release an acidic thiol or selenol upon reaction with oxidized developing agent (black-and-white or, preferably, aromatic primary amino colour developing agents). More details about these compounds can be found in U.S. Pat. No. 3,705,801.

In general BIR-compounds can be used which are related to the known thio-substituted development inhibitor releasing compounds e.g. those described in U.S. Pat. No. 3,632,345 and in the published German Patent Applications DE-OS Nos. 2,015,814, 2,015,867, 2,359,295, 2,405,442 and 2,617,310 in that the development inhibiting substituent is replaced by a ballasted bleach inhibitor substituent e.g. of the type described in the above BIR-couplers and BIR-hydroquinones.

The above BIR-couplers, BIR-hydroquinones and BIR-compounds are bleach inhibitor releasing compounds which by reaction with oxidized developing agent split off the ballasted bleach inhibitor.

Other useful bleach inhibitor releasing compounds are those related to the compounds that have been described for releasing photographic useful groups e.g. a dye by intramolecular ring closure upon oxidation as described in U.S. Pat. Nos. 3,443,939, 3,443,940, 3,443,941, and 3,751,406 or by a redox reaction followed by alkali cleavage as described e.g. in British Patent 1,405,662 and U.S. Ser. No. 351,673 filed Apr. 16, 1973. BIR-compounds based on this principle are related to the dye-releasing compounds described in these patents wherein the dye moiety is replaced by a bleach inhibitor moiety e.g. a bleach inhibitor moiety of the type described for the BIR-couplers and BIR-hydroquinones referred to hereinbefore.

Preferred BIR-compounds of the latter type are sulphonamidophenols and naphthols of the type described in British Patent No. 1,405,662 containing a bleach inhibitor moiety attached to the sulphonamidogroup instead of a dye moiety. As a consequence of silver development, the oxidized silver halide developing agent oxidizes the sulphonamidophenol to a quinoneimide which reacts with alkali to release the bleach inhibitor.

Particularly suitable are compounds of the type described in the published German Patent Application DE-OS No. 2,650,712 wherein the development inhibiting moiety is replaced by a ballasted bleach inhibitor moiety e.g. of the type used in the BIR-couplers and BIR-hydroquinones referred to hereinbefore.

As an alternative to the above compounds releasing through a redox reaction followed by alkali cleavage a bleach inhibitor, it is possible to use compounds in their oxidized form and thus capable of releasing by alkali the bleach-inhibitor, the said oxidized form being reduced by non-oxidized developing agent in the non-developed areas to form the reduced compound with substantially reduced capability of releasing bleach inhibitor by alkali.

In the processes and elements described hereinbefore there are not only used bleach inhibitor compounds or bleach inhibitor releasing compounds but also non-diffusible bleach accelerator releasing (BAR) compounds which release image-wise by alkaline development of a silver halide emulsion layer a diffusible bleach accelerator.

The non-diffusible BAR compounds are preferably colourless and also form colourless reaction products upon release of the bleach accelerator.

The BAR-compounds may be of the same type as described hereinbefore for the BIR-compounds with the difference that the image-wise releasable ballasted bleach inhibitor moiety is now a diffusible bleach accelerator moiety. In this connection there can be referred to Research Disclosure October 1973, Disclosure No. 11449. Particularly useful BAR-compounds are those which by reaction with oxidized developing agent form colourless compounds and release the bleach accelerator in alkaline medium. Such BAR-compounds have been described in the published German Patent Application DE-OS No. 2,547,691.

Alternatively the BAR-compounds can be of the type that are capable of releasing by alkaline cleavage a bleach accelerator moiety that are also capable of reaction with an oxidized silver halide developing agent before substantial release of said bleach accelerator, to provide a reaction product having a substantially lower rate of release of said bleach accelerator moiety. This means that in the areas where metallic silver is developed the BAR-compounds are converted into a form which does not release the bleach accelerator moiety under alkaline conditions whereas in the undeveloped areas, bleach accelerator is released from the BAR-compound. These BAR-compounds thus release the bleach accelerator where the developing agent does not become oxidized during development.

BAR-compounds of this type can be e.g. of the type described in Belgian Patent No. 810,195 (=U.S. Ser. No. 3,266,628 filed Jan. 26, 1973) and of the type described in U.S. Pat. No. 3,980,479 wherein the photographic useful group that is split off is a bleach accelerator moiety.

It is also possible to use the latter BAR-compounds in their oxidized forms which do not release the bleach accelerator moiety, the oxidized forms being reduced by reaction with non-oxidized developing agent and in their thus reduced forms being capable of releasing by alkaline cleavage the bleach accelerator moiety. BAR-compounds of the latter type can be of the type described in DE-OS No. 2,809,716 or in European Patent Application 0004399, wherein the photographic useful group that is split off is a bleach accelerator moiety.

Bleach accelerators are usually, as is known in the art, simple heterocyclic mercapto compounds and thus the bleach accelerator releasing compounds comprise usually as bleach accelerator moiety a heterocyclic thio group. Typical examples of such heterocyclic mercapto compounds are mercaptotetrazole compounds e.g. 1H-2-mercaptotetrazole, mercaptotriazole compounds e.g. 3-mercapto-1,2,4-triazole and 3-mercapto-4-phenyl-5-aminotriazole, mercaptoimidazoline compounds e.g. 2-mercaptoimidazolin, mercaptopyrimidine compounds e.g. 2-mercapto-4-aminopyrimidine, mercaptopurine compounds e.g. 2-amino-4-mercaptopurine, mercaptoquinolidine compounds e.g. 4-mercapto-4-H-quinolidine and mercaptothiadiazole compounds e.g. 2-amino-5-amino-1,4,5-thiadiazole.

The heterocyclic thiol bleach accelerators differ from the heterocyclic thiol bleach inhibitors generally in that they have substantially lower molecular weight.

Examples of BAR-compounds capable of coupling with an oxidized developing agent in particular p-phenylene diamine developing agent to form a colourless compound and a diffusible bleach accelerator are acetophenone derivatives e.g.

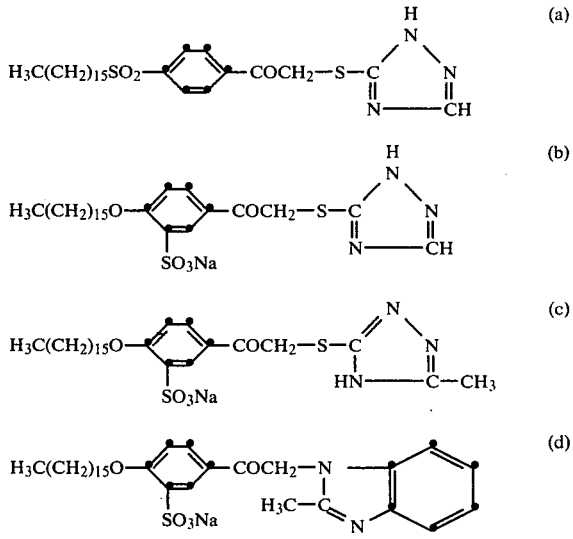

Materials according to the present invention comprise a silver halide emulsion layer called accelerator release layer containing a BAR-compound. This auxiliary layer can comprise silver chloride, silver bromide, silver bromoiodide, silver chlorobromide, silver chlorobromoiodide or mixtures thereof.

The silver halide content of the auxiliary layer can vary widely, typical coverages being from about 200 milligrams of silver as silver halide per square meter or less to 1500 milligrams per square meter or more. It is preferred that the accelerator release layer contains from about 250 milligrams per square meter to 1000 milligrams per square meter silver as silver halide and especially from about 300 milligrams per square meter to about 750 milligrams per square meter. Particularly useful accelerator release layers contain from about 350 to about 750 milligrams per square meter silver as silver halide.

The grain size of the silver halide of the accelerator release layer can vary widely. For example, the average silver halide grain size typically ranges from about 0.05 micron or less to about 0.5 micron or greater. An average grain size of from about 0.05 micron to about 0.2 micron is preferred.

As referred to hereinbefore, the accelerator release silver halide emulsion layer can be of the negative type or direct-positive type. Particularly good direct-positive emulsions are fogged direct-positive emulsions. Such fogged direct-positive emulsions are uniformly fogged and therefore contain a latent image throughout.

This latent image is then destroyed in direct proportion to exposure. Upon development in conventional black and white developers, a reversal image is formed, the density of which is in inverse proportion to the exposure received, i.e. greatest density is found in the areas of no exposure and least density is found in areas of greatest exposure. Direct-positive emulsions are well known in the art.

The accelerator release layer comprising the bleach accelerator releasing compound may comprise a scavenger for oxidized developing agent such as a hydroquinone e.g. dioctyl-hydroquinone. As used herein the scavenger refers to any compound which reacts with oxidized developing agent to prevent the wandering of such oxidized agent away from a site of development. If the oxidized colour developing agent should wander away from the site of development, it can react with a colour coupler at some other location, for example, in one of the picture recording units in the sound film to produce a dye. The production of this dye at a location away from the site of colour development would cause false colouration of the developed image. Oxidized developer stemming from the picture recording units and wandering to the accelerator-release layer should also be avoided in order not to affect the image-wise release of the bleach accelerator.

The materials for motion picture plus sound recording according to the invention normally contain non-diffusible colour couplers in the picture recording silver halide layers. Exposed materials are processed in the presence of an aromatic primary amine colour developing agent, such as the well known p-phenylenediamines. The oxidized colour developing agent resulting from the reduction of that latent silver halide image couples with the incorporated coupler to form a non-diffusible dye. Examples of non-diffusible photographic couplers which can be incorporated into the picture recording silver halide emulsion layers of the novel photographic materials are the pyrazolone couplers for magenta, the phenolic and naphtholic couplers for cyan and yellow-forming open-chain ketomethylene couplers. These couplers are well known in the art of silver halide colour photography.

One or more of the picture recording silver halide layers, and in particular of the red- and green-sensitized emulsion layers of a three colour motion picture film material, comprises as referred to hereinbefore a non-diffusible bleach inhibitor or a compound releasing such non-diffusible bleach inhibitor. In the negative system of photography a non-diffusible bleach inhibitor can be used. As is apparent from the above a bleach inhibitor releasing compound is used in the reversal system of photography.

The picture recording units can be composed of any of the commonly employed silver halide emulsion layer used in multicolour motion picture films.

The quantity of bleach inhibitor or bleach inhibitor releasing compound in the picture recording layer(s) of a picture plus sound recording film material should be such to sufficiently protect the developed silver from being bleached in the absence of a bleach accelerator.

The quantity of non-diffusible bleach inhibitor that must be present or be formed to retain substantially all of the silver or other oxidatively bleachable colouring matter from being bleached in the absence of a bleach accelerator can be readily determined by one skilled in the art. It can be less than $1.10^{-5}$ mol/sq.m and more than $5.10^{-3}$ mol/sq.m. It is usually between $5.10^{-5}$ mol and $5.10^{-4}$ mol/sq.m.

The quantity of bleach accelerator releasing compound can also be determined easily by one skilled in the art. It must be such that it overcomes the bleach inhibiting effect of the bleach inhibitor or bleach inhibitor releasing compound. It is generally comprised between $1.10^{-4}$ mol and $1.10^{-2}$ mol per sq.m.

The image-wise controlled bleaching of coloured layers according to the present invention is illustrated by the following examples, without however limiting it thereto.

EXAMPLE 1

Onto a transparent film support, a non-light-sensitive layer was coated containing per sq.m 2.3 g of gelatin, 0.76 g of finely divided black colloidal silver and 0.15 g of bleach inhibiting compound having the formula I:

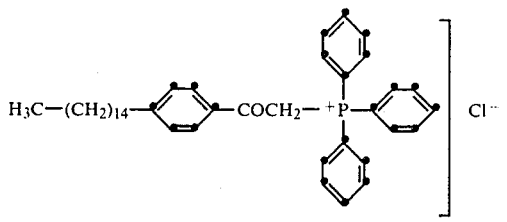

I

On top of said non-light-sensitive layer a light-sensitive silver chlorobromide emulsion layer was coated, containing per sq.m an amount of silver halide corresponding to 0.48 g of silver nitrate, 6.3 g of gelatin and 0.4 g of BAR-compound having the formula II:

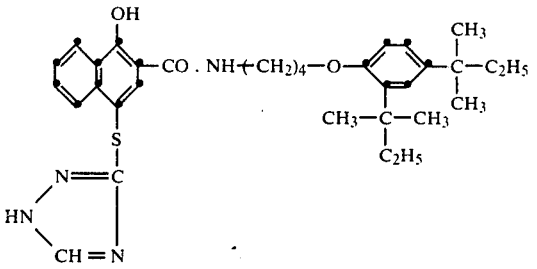

II

The light-sensitive layer was overcoated with an anti-stress layer. The light-sensitive emulsion was exposed through a grey sensitometric wedge. Thereupon the material was processed according to treatment A or treatment B.

Treatment A

1. Development in developer 1 (given hereinafter) at 36.7° C. for 3 min 30 s.
2. Rinsing in running water for 45 s.
3. Bleach-fixing in blix 2 (given hereinafter) at 27° C. for 5 min.
4. Rinsing in running water for 5 min.

Treatment B

Identical with treatment A, with the only difference that the bleach-fixing step occurred in blix 3 (given hereinafter).

Developer 1

| | |
|---|---|
| water | 900 ml |
| sodium hexametaphosphate | 1 g |
| anhydrous sodium sulphite | 4.35 g |
| 2-amino-5-diethylaminotoluene hydrochloride | 2.95 g |
| anhydrous sodium carbonate | 17.1 g |
| anhydrous sodium bromide | 1.72 g |
| 7.0 N sulphuric acid | 0.62 ml |
| water to make | 1000 ml |
| pH (at 27.2° C.) | 10.53 |

Blix 2

| | |
|---|---|
| water | 700 ml |
| anhydrous sodium sulphite | 10 g |
| 3-mercapto-1,2,4-triazole | 2.5 g |
| tetrasodium salt of ethylenediamine tetraacetic acid | 13 g |
| iron(III)-sodium salt of ethylenediamine tetraacetic acid | 50 g |
| ammoniumbromide | 10 g |
| ethylenediamine tetraacetic acid | 5 g |
| ammonium thiosulphate | 150 g |
| water to make | 1000 ml |
| pH | 6.3 |

Blix 3

Identical with blix 2 but without the mercaptotriazole.

Density reading occurred by means of a colour densitometer (recording densitometer Joyce-Loebl). The results are represented in FIG. 1 (treatment A) and FIG. 2 (treatment B) of the accompanying drawings.

With the bleach accelerator (mercaptotriazole) containing blix of composition 2 a cyan negative wedge image is formed (FIG. 1) which means that all silver has been bleached. When using the blix of composition 3 containing no bleach accelerator the bleaching of the colloidal silver in the non-light-sensitive layer occurs proportional to the amount of bleach accelerator released by the cyan coupler which in its turn is proportional to the exposure. A cyan negative image (curve A of FIG. 2) is formed in the light-sensitive layer and a silver positive image (curve B of FIG. 2) is formed by the non-bleached silver in the non-light-sensitive layer.

A cyan forming BAR-coupler was used for illustrative purposes. If a colourless forming coupler were used only a direct-positive silver image would have been formed.

EXAMPLE 2

Photographic material

Onto one side of a film support provided at the other side with a carbon black antihalation coating the following layers were coated subsequently:

(a) a red-sensitized silver bromochloride emulsion layer comprising per sq.m silver halide in an amount corresponding to 1.1 g of silver nitrate, 5.6 g of gelatin, 1.9 g of a cyan coupler of the following formula III and 0.2 g of a cyan BIR-coupler of the following formula IV:

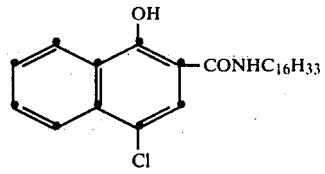

III

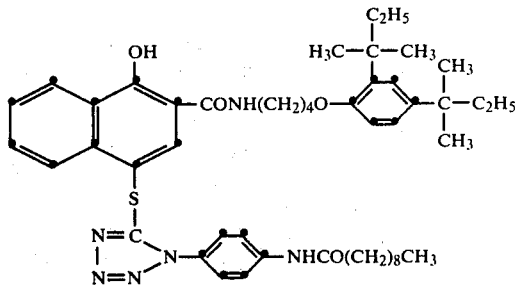

IV (b) a gelatin intermediate layer comprising 2 g of gelatin per sq.m.

(c) a green-sensitized silver chloride emulsion layer comprising per sq.m an amount of silver chloride corresponding to 1 g of silver nitrate, 5.4 g of gelatin and 0.8 g of a BAR-compound of the following formula V:

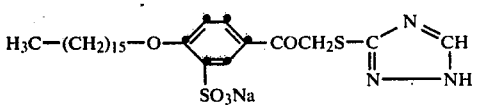

V (d) a gelatin antistress layer.

The material was cut into several strips.

Exposure: strips of the photographic material were exposed either through a wedge with red light only, or through a wedge with red light and overall with green light. The overall green light exposure was such to render the green-sensitized layer completely developable.

Processing: The exposed strips were processed either according to treatment A or according to treatment B.

(a) Treatment A:

1. prebath—10 s—27° C.
2. removal of carbon black coating—2 s
3. colour development—3 min 30 s—36.5° C. (in developer 1 of example 1)
4. rinsing 45 s
5. bleach fixing 2 min—27° C. (in blix 2 of example 1)
6. rinsing—2 min (b) Treatment B: same as treatment A with the difference that the bleach fixing solution did not contain mercaptotriazole.

The prebath used had the following composition (per liter):

| | |
|---|---|
| borax | 20 g |
| anhydrous sodium sulphate | 100 g |
| sodium hydroxide | 1 g |
| pH 9.25 | |

The infrared-densities corresponding with the maximum red-light exposure were measured on a Macbeth Densitometer TD 206 for each exposure and processing embodiment. The results are listed in the following table.

| Processing | Red-light exposure (wedge) | Red-light exposure (wedge) plus green-light exposure (overall) |
|---|---|---|
| Treatment A | 0.82 | 0.79 |
| Treatment B | 1.53 | 0.81 |

The large difference in density between treatment A and B in the case of the red-light exposure only (which means that the layer containing the BAR-compound was not exposed) is due to the metallic silver that is bleached in treatment A but not in treatment B the bleachfix not containing the bleach accelerating mercaptotriazole in the latter treatment.

When the layer containing the BAR-compound is exposed the metallic silver is bleached not only in treatment A but also in treatment B.

We claim:

1. A process wherein a photographic silver image is formed in at least one hydrophilic colloid layer called "silver-imaging layer" of a light-sensitive photographic material incorporating silver halide, by means of exposure and alkaline development steps, followed by bleaching of quantities of silver which are present in areas of said layer extraneous to those where imaging silver is required, characterized in that a non-diffusible silver bleach inhibitor is initially present in said silver-imaging layer or is released therein during processing of the material but before bleaching, to prevent bleaching of the required imaging silver in such layer in the bleaching step and in that the prevention of the bleaching of the silver by the bleach inhibitor in the areas extraneous to those where imaging silver is required is counteracted by the presence in the corresponding areas of such layer of a bleach accelerator which is caused to define into such areas from an adjacent hydrophilic colloid layer called "accelerator release layer" during the development processing of the material.

2. A process according to claim 1 characterized in that in the photographic material the silver-imaging layer(s) initially contain(s) in overall distribution therein, either colloidal silver or silver halide, which has been rendered developable by preliminary overall exposure or chemical fogging, in addition to a non-diffusing ballasted silver bleach inhibitor and/or a non-diffusing bleach inhibitor releasing compound (BIR-compound) capable of forming a non-diffusible silver bleach inhibitor, and the accelerator release layer is a light-sensitive silver halide emulsion layer containing a non-diffusing bleach accelerator releasing compound (BAR-compound) capable of forming a diffusible bleach accelerator upon alkaline development of a latent silver image formed in such accelerator release layer, and in that the process comprises the steps of (1) image-wise exposing the said accelerator release layer, (2) developing the photographic material in alkaline medium by means of a developing agent whereby in the exposed accelerator release layer a diffusible bleach accelerator is released in a distribution, within the area of the material, which depends on and is in accordance with the silver image developed therein, and diffuses in such distribution into the silver-imaging layer(s), and (3) treating the photographic material with a silver bleach solution and a fixing solution, or with a bleach-fixing solution.

3. A process according to claim 2, wherein the said accelerator release layer is a negative silver halide emulsion layer containing as BAR-compound a substantially colourless compound that is capable of reacting with oxidized developing agent and releasing in alkaline medium by said reaction a substantially colourless diffusible bleach accelerator or that is capable of releasing a diffusible substantially colourless bleach accelerator under alkaline conditions but is capable of being reduced by non-oxidized developing agent to form by said reduction a reaction product having a substantially lower rate of release of the bleach accelerator under alkaline conditions.

4. A process according to claim 3, wherein the silver-imaging layer(s) comprise(s) developable silver halide formed therein by overall exposure or chemical fogging and further comprise(s) a substantially colourless non-diffusible silver bleach inhibitor or a bleach inhibitor releasing compound which is either capable of releasing a non-diffusible substantially colourless bleach inhibitor under simple alkaline conditions or capable of releasing a non-diffusible substantially colourless bleach inhibitor by reaction with oxidized silver halide developing agent and alkali.

5. A process according to claim 1 characterized in that a photographic material is used wherein the silver-imaging layer(s) comprise(s) a light-sensitive silver halide emulsion containing a non-diffusing ballasted silver bleach inhibitor and/or a non-diffusing bleach inhibitor releasing compound (BIR-compound) capable of forming a non-diffusible silver bleach inhibitor and the said adjacent accelerator-release layer is a hydrophilic colloid layer which contains developable silver halide in addition to a non-diffusing bleach accelerator releasing compound (BAR-compound) capable of forming a diffusible bleach accelerator upon alkaline development of developable silver halide in said layer, and in that the process comprises the steps of (1) image-wise exposing the silver-imaging layer(s) to form a latent silver image therein, (2) developing the photographic material in alkaline medium by means of a developing agent whereby a diffusible bleach accelerator is released in the accelerator release layer in a distribution within the area of the material which depends on the development of silver in that layer and diffuses in corresponding distribution into the silver-imaging layer(s) in which silver image is formed by the alkaline development, and (3) treating the photographic material with a silver bleach solution and fixing solution or with a bleach-fixing solution.

6. A process according to claim 1, wherein the said photographic material is a photographic motion picture material for the simultaneous silver sound and colour picture recording comprising one or more colour picture recording units and the said silver-imaging layer(s) is (are) colour image forming light-sensitive silver halide emulsion layers of the colour picture recording units and the said adjacent accelerator-release layer from which the bleach accelerator diffuses is an auxiliary light-sensitive silver halide emulsion layer of said material, the latter layer being capable of being exposed without image-forming exposure of the picture recording units and comprising a non-diffusing bleach accelerator releasing compound (BAR-compound) which is capable of releasing the bleach accelerator upon reaction with oxidized developing agent in alkaline medium or which is capable of losing its capability of releasing in alkaline medium a bleach accelerator upon reduction by non-oxidized developing agent and wherein the process comprises the steps of:

(1) overall exposing the accelerator-release layer in the picture recording area of the film only if the said accelerator-release layer comprises a negative type silver halide emulsion or in the sound-track recording area only if such accelerator release layer comprises a direct-positive type silver halide emulsion, such overall exposure being effected without exposing the picture recording units;

(2) image-wise exposing the picture area and sound track area of the picture recording units (without image-forming exposure of the accelerator-release layer or at least that area thereof which has not been overall exposed);

(3) colour developing the material with an aromatic primary amino developing agent to form a picture record comprising silver and dye in the picture recording layers and silver in the picture record area thereof of the accelerator-releasing layer, thereby releasing in the picture record area of the accelerator-release layer diffusible bleach accelerator, this bleach accelerator diffusing into the picture record area of the picture recording units thus neutralizing the bleach inhibiting effect of the bleach inhibitor which was initially present in the silver-imaging layer(s) of said units or was formed therein by the alkaline development or formed therein together with the silver image from a bleach inhibitor releasing compound, and (4) removing the residual silver halide and bleachable silver remaining after step (3) by bleaching and fixing, while retaining in the sound-track area of the silver-imaging layer(s) of the picture recording units, silver whose bleaching is inhibited by the bleach inhibitor or released bleach inhibitor not neutralized in this area.

7. A process according to claim 6 with the modification that the BAR-compound in the accelerator-release layer is a compound which loses its bleach accelerator release capability in alkaline medium upon reaction with oxidized developing agent or is a compound which is capable of releasing the bleach accelerator upon reaction with non-oxidized developing agent in alkaline medium, and in that in step (1) the accelerator-release layer is overall exposed in the sound-track recording area only in the case that the accelerator-release layer comprises a negative type emulsion and in the picture recording area only in the case that the accelerator-release layer comprises a direct-positive type, such overall exposure being effected without exposing the picture recording units; so that in development step (3) silver is formed in the sound-track recording area of the accelerator-release layer.

8. A process according to claim 1, wherein the said photographic material is a photographic motion picture material for the simultaneous silver sound and colour picture recording comprising one or more colour picture recording units and the said silver-imaging layer(s) is (are) colour image forming light-sensitive silver halide emulsion layers of the colour picture recording units comprising a bleach inhibitor releasing compound capable of reacting with an oxidized aromatic primary amino colour developing agent to release thereby a non-diffusible bleach inhibitor, and the said adjacent accelerator-release layer from which the bleach accelerator diffuses is an auxilary light-sensitive silver halide emulsion layer of said material, the latter layer being capable of being exposed without image-forming exposure of the picture recording units and comprising a non-diffusible bleach accelerator releasing compound which is capable of reacting with an oxidized aromatic primary amino colour developing agent to release thereby a bleach accelerator, and wherein the process comprises the steps of:

(1) overall exposing the accelerator-release layer only in the sound-track recording area of the film without exposure of the picture recording area, (2) image-wise exposing the picture recording units in the picture area and sound-track area, (3) black-and-white development to form a negative silver image in the picture recording units and silver in the sound-track area of the auxiliary layer, (4) overall fogging and colour developing with an aromatic primary amino compound the remaining silver halide in the material to form in the picture recording layers a picture and sound record comprising silver and dye and in the auxiliary layer silver in the picture record area thereof, oxidized aromatic primary amino developing agent reacting in the picture record area of the auxiliary (accelerating-release) layer with the bleach accelerator releasing compound to release diffusible bleach accelerator and in the silver-imaging layer(s) of the picture record units with the bleach inhibitor releasing compound to release bleach inhibitor, the said released bleach inhibitor being neutralized in its inhibiting effect by the diffusing bleach accelerator in the picture record area of the silver-imaging layer(s) of the picture record units, and (5) removing any residual silver halide and bleachable silver remaining after such colour development by bleaching and fixing, while leaving in the sound track area of the silver-imaging layer(s) of the picture recording units, the silver which was formed during colour development and was made unbleachable by released bleach inhibitor not neutralized in that area.

9. A process according to any of claims 6, 7 and 8 wherein overall exposure of the sound-track area only or picture record area only of the auxiliary silver halide emulsion layer has been effected during manufacture of the photographic element and this overall exposure step is thus omitted in the process of any of claims 6, 7, and 8.

10. A photographic material suitable for use in a process according to claim 1 comprising a support carrying (1) a hydrophilic colloid silver halide emulsion layer (accelerator-release layer) containing a non-diffusing bleach accelerator releasing compound (BAR-compound) capable of forming a diffusible bleach accelerator upon alkaline development of a latent silver image which is present or can be formed in the said silver halide emulsion layer, and (2) at least one further hydrophilic colloid layer (silver-imaging layer) which is in water-permeable relationship with the said accelerator-release layer and which contains either a light-sensitive silver halide emulsion or in overall distribution colloidal silver or silver halide which has been rendered overall developable by overall exposure or chemical fogging and which silver imaging layer contains a non-diffusing ballasted silver bleach inhibitor and/or a non-diffusing bleach inhibitor releasing compound (BIR-compound) capable of forming a non-diffusible silver bleach inhibitor in the areas where the colloidal silver is present or developed silver is formed.

11. A photographic material according to claim 10 wherein the BAR-compound is:

(a) a substantially colourless BAR-compound capable of reacting with oxidized developing agent and capable of releasing in alkaline medium by said reaction a substantially colourless diffusible accelerator of bleaching, or (b) a substantially colourless BAR-compound capable of releasing a diffusible substantially colourless bleach accelerator under alkaline conditions and capable of being reduced by non-oxidized developing agent to form by said reduction a reaction product having a substantially lower rate of release of the bleach accelerator under alkaline conditions, or (c) a substantially colourless BAR-compound capable of releasing under alkaline conditions a substantially colourless diffusible accelerator of bleaching and capable of reacting with oxidized developing agent to form a reaction product having a substantially lower rate of release of the bleach accelerator under alkaline conditions, or (d) a substantially colourless BAR-compound capable of being reduced by non-oxidized developing agent to form by said reduction a reaction product having a substantially higher rate of release of a diffusible substantially colourless bleach accelerator under alkaline conditions.

12. A photographic material according to claim 10, wherein the BIR-compound is:

(a) a compound capable of releasing a non-diffusible bleach inhibitor under alkaline conditions, or (b) a compound capable of releasing non-diffusible bleach inhibitor by reaction with oxidized silver halide developing agent (formed by the development of developable silber halide in said layer) and alkali; or (c) a compound capable of releasing non-diffusible bleach inhibitor under alkaline conditions and capable of being reduced by non-oxidized developing agent to form by said reduction a reaction product having a substantially lower rate of release of the bleach inhibitor under alkaline conditions.

13. A photographic material according to claim 10, wherein the material is one for the simultaneous recording of silver sound and colour images comprising one or more colour picture recording units each unit being composed of one or more silver halide emulsion layers characterized in that the said silver-imaging layer(s) comprises light-sensitive silver halide and a said non-diffusing silver bleach inhibitor or BIR-compound, and forms one or more silver halide emulsion layers of the colour picture recording units, and the said accelerator-release layer containing the said BAR-compound forms an auxiliary silver halide emulsion layer of said material which is capable of being exposed without image-forming exposure of the picture recording unit(s).

14. A photographic material according to claim 13 which comprises a transparent support having coated thereon a plurality of picture recording photographic units, each unit comprising one or more silver halide emulsion layers which are so disposed and sensitized that each photographic unit is essentially sensitive to a different primary colour region of the visible spectrum and an auxiliary silver halide emulsion layer (accelerator-release layer) which can be image-wise exposed without image-forming exposure of the picture recording layers, the said layer containing the BAR-compound, and at least one emulsion layer of at least one of the picture recording units comprising at least one non-diffusible bleach inhibitor or BIR-compound.

15. A photographic material according to claim 13, wherein each picture recording layer contains a non-diffusing photographic colour complex capable of reacting with oxidized aromatic primary amino colour developing agent to form a dye.

16. A photographic material according to claim 15 comprising a support having coated thereon:

(1) a picture recording colour-forming unit comprising at least one photographic silver halide emulsion layer primarily sensitive to the blue region of the visible spectrum and containing a non-diffusing photographic coupler which reacts with oxidized aromatic primary amine colour developing agent to form a non-diffusing yellow dye;

(2) a picture recording photographic colour-forming unit comprising at least one silver halide emulsion layer primarily sensitive to the red region of the visible spectrum and containing a non-diffusing photographic coupler which reacts with oxidized aromatic primary amine colour developing agent to form a non-diffusing cyan dye;

(3) a picture recording photographic colour-forming unit comprising at least one silver halide emulsion layer primarily sensitive to the green region of the visible spectrum and containing a non-diffusing photographic coupler which reacts with oxidized aromatic primary amine colour developing agent to form a non-diffusing magenta dye; and (4) an auxiliary photographic silver halide emulsion layer which can be image-wise exposed without image-forming exposure of the picture recording units wherein the silver halide emulsion layers of the red- and green-sensitized picture recording units comprise the non-diffusible bleach inhibitor or BIR-compound and the said auxiliary silver halide emulsion layer comprises the BAR-compound.

17. A photographic element according to claim 16, wherein the picture recording units are disposed on the support in the order of sequence given in claim 16 and the auxiliary layer is situated at least underneath picture recording unit (3).

18. A photographic element according to claim 16, wherein the support carries the said picture recording units in the following order of sequence: recording unit (2), recording unit (3) and recording unit (1), and a yellow filter layer is located between recording units (1) and (3).

19. A photographic element according to any of claims 13 to 16, wherein the element is one for simultaneous colour picture and sound recording whereof the said auxiliary silver halide emulsion layer has been overall exposed to actinic radiation (or chemically fogged) in the picture recording area thereof only or in the sound-track recording area thereof only whereas the picture recording units have not been overall exposed (or fogged).

* * * * *

UNITED STATES PATENT AND TRADEMARK OFFICE

CERTIFICATE OF CORRECTION

PATENT NO. : 4,269,923

DATED : May 26, 1981

INVENTOR(S) : Raymond A. Roosen et al

It is certified that error appears in the above-identified patent and that said Letters Patent is hereby corrected as shown below:

In the heading, please insert

-- [30] Foreign Application Priority Data

Feb 2, 1979 [GB] United Kingdom ..... 79/03676

In the Specifications:

Column 6, Line 50, "stage" should read -- stages --

Column 15, Line 36, example "20" part of the formula set forth as

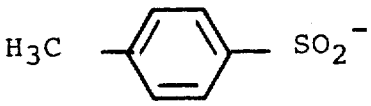

should read

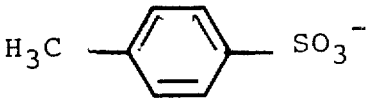

Column 19, Line 56, "layer" should read -- layers --

UNITED STATES PATENT AND TRADEMARK OFFICE

CERTIFICATE OF CORRECTION

PATENT NO. : 4,269,923

DATED : May 26, 1981

INVENTOR(S) : Raymond A. Roosen et al

It is certified that error appears in the above-identified patent and that said Letters Patent is hereby corrected as shown below:

In the Claims:

Column 23, Claim 1, Line 39, "define" should read -- diffuse --

Column 26, Claim 8, Line 28/29, "accelerating" should read -- accelerator --

Column 27, Claim 12, Line 42, "silber" should read -- silver --

Column 28, Claim 15, Line 12, "complex" should read -- coupler --

Signed and Sealed this

*Twenty-seventh* Day of *September 1983*

[SEAL]

*Attest:*

GERALD J. MOSSINGHOFF

*Attesting Officer*

*Commissioner of Patents and Trademarks*